US005323615A

United States Patent [19]

Glans

[11] Patent Number: 5,323,615

[45] Date of Patent: Jun. 28, 1994

[54] CRYOGENIC COOLER

[76] Inventor: Eric R. Glans, 912 - 86th Ave. NW., Coon Rapids, Minn. 55433

[21] Appl. No.: 59,247

[22] Filed: May 7, 1993

[51] Int. Cl.[5] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 2,966,035 | 12/1960 | Gifford | 62/6 |
| 3,188,818 | 6/1965 | Hogan | 62/6 |
| 3,188,819 | 6/1965 | Hogan | 62/6 |
| 3,303,658 | 2/1967 | Chellis | 62/6 |
| 3,609,982 | 10/1971 | O'Neil et al. | 62/6 |
| 3,613,385 | 10/1971 | Hogan et al. | 62/6 |

*Primary Examiner*—William E. Tapolcai
*Attorney, Agent, or Firm*—Nawrocki, Rooney & Sievertson

[57] ABSTRACT

A closed system for effecting cryogenic cooling. The system includes a cylinder which houses therewithin a piston disposed for reciprocation within the cylinder. The cylinder is in fluid communication with a closed reservoir. A conduit interconnects the reservoir to a first chamber defined at a first end of the cylinder. A branch passage diverges from the conduit to provide fluid communication between the conduit and a second chamber defined within the cylinder at a second end thereof. A first conduit segment is, thereby, defined between the intersection of the branch passage and the entrance of the conduit into the cylinder at the first end thereof, and a second conduit segment is defined between the intersection of the branch passage with the conduit and the entry of the conduit into the reservoir. Heat exchange regeneration means are interposed in the first conduit segment, and a first valve is interposed in the first conduit segment between the heat exchange regeneration means and the intersection of the branch passage with the conduit. A second valve is interposed in the second conduit segment.

7 Claims, 1 Drawing Sheet

CRYOGENIC COOLER

TECHNICAL FIELD

The present invention deals broadly with the field of cryogenics. More specifically, however, the invention is related to cryogenic cooler technologies. Specifically, the invention is related to a cooler broadly categorized as an Ericcson cryogenic cooler.

BACKGROUND OF THE INVENTION

In recent years, cryogenic technologies have been ever increasingly developed. The applications for cryogenic coolers are innumerable.

Cryogenic coolers, or cryocoolers, as they have come to be identified, are broadly categorized into one of two groups. These groups are based upon the method of gas flow regulation. The first group is referred to as Stirling coolers, and the second group is known as Ericcson coolers. In the former classification, gas flow is regulated by volume changes. In the second category, gas flow is regulated by valves.

Ericcson coolers are, in turn, sub-categorized as Solvey coolers, Gifford-McMahon coolers, and Postle coolers. The last type of cooler enumerated above is provided with a free displacer and includes self-activated valves.

The Postle cooler was, in turn, modified by being provided with a driven displacer. Additionally, modifications were made to provide both low and high pressure reservoirs or surge volumes. This modified Postle cooler is now known as the Gifford-McMahon cooler (or G-M cooler).

The Solvey cooler is, in many respects, similar to the G-M cooler. The most significant difference between these latter two coolers is that the Solvey cooler extracts work from an expanding gas by using a piston rather than a displacer.

Both the Solvey and the G-M coolers have both high and low pressure reservoirs. In these two types of coolers, the pressure within the low pressure reservoirs is kept below that present at any time prior to hot blow regeneration. As a result, fluid is permitted to exit the cooler by being drawn out of the cooler into the low pressure reservoir. Consequently, a heat exchange regenerator is cooled during the process in order to prepare for a subsequent cycle. Fluid within the low pressure reservoir is then compressed by an external compressor and then delivered to the high pressure reservoir.

All of such coolers known in the art have inherent problems. Illustrative is the fact that multiple reservoirs are provided. Additionally, external compressors are required. In essence, efficiency of such coolers is reduced in view of various factors.

It is to the problems and dictates of the prior art that the present invention is directed. It is an improved cryogenic cooler which addresses the problems of the prior art and provides unique solutions.

SUMMARY OF THE INVENTION

The present invention is apparatus for effecting cryogenic cooling. A system comprising the apparatus includes a cylinder which is defined by an enclosing wall. A piston is disposed within the cylinder for reciprocating movement therewithin. The piston, it is intended, moves between a first position proximate a first end of the cylinder and a second position proximate the second end of the cylinder. The piston defines, by its position within the cylinder, a first chamber within the cylinder enclosing wall and proximate the first end thereof. Similarly, a second chamber is defined within the cylinder enclosing wall proximate the second end thereof. The system further includes means for driving the piston between its first and second positions, and the outer surface of the piston is sealed, with respect to the enclosing wall of the cylinder, as it moves between the first and second positions. As a result, the first and second chambers are in fluid isolation with respect to one another. The invention also includes a single closed fluid reservoir and a conduit which interconnects the reservoir and the first chamber. As a result, fluid communication is provided between the reservoir and the first chamber. A branch passage diverges from the conduit to the second chamber. As a result, the intersection of the branch passage with the conduit defines a first segment of the conduit which extends between the intersection and the first chamber, and a second segment of the conduit which extends between the intersection and the reservoir. Heat exchange regeneration means are interposed in the first conduit segment, and a first valve controls fluid flow through the first conduit segment between the intersection of the branch passage with the conduit and the regeneration means. Also included is a second valve which is interposed in the second conduit segment. Means are provided to control operation of the first and second valves in response to the position of the piston within the cylinder. Coordination is such that, when the piston is at its first position, both the first and second valves are open. As the piston travels, however, from its first position to its second position, the first valve closes at a point along the run of the piston. When the piston achieves its second position, the first valve opens, and the second valve closes. Finally, the piston, when it returns to its first position, effects opening of both valves.

In a preferred embodiment, the means by which the piston is driven includes a shaft which mounts the piston at one end thereof. The drive means can further include a motor for imparting reciprocation to the shaft and, in turn, to the piston. In the preferred embodiment, at least a portion of the reservoir is axially aligned with the cylinder, and the axially aligned portion of the reservoir is segregated from the cylinder by a separating wall. It is envisioned that the motor for effecting reciprocation of the piston be mounted proximate the separating wall and within the reservoir.

One embodiment of the invention envisions employment of means to facilitate maintenance of the alignment and minimize vibration of the shaft as it reciprocates along an intended axis. Such means can include a pair of counter-balanced rotors operatively connected to an end of the shaft within the reservoir. Typically, mechanical linkages are employed to effect connection.

In one embodiment of the invention, the first end of the cylinder can be provided with a reduced diameter portion. Such a reduced diameter portion would, typically, be disposed coaxially with, and extend coaxially from, the first end of the cylinder. In that embodiment, a regenerative displacer, slaved to the main piston, would be provided in a manner as discussed. The regenerative displacer would be fixed to the main piston at a distance so that, as the main piston reciprocates within the cylinder, the regenerative displacer would reciprocate within the reduced diameter portion of the cylinder.

The present invention is thus an improved cryogenic cooler. More specific features and advantages obtained in view of those features will become apparent with reference to the DETAILED DESCRIPTION OF THE INVENTION, appended claims, and accompanying drawing figures.

DETAILED DESCRIPTION OF THE INVENTION

Figure 1:
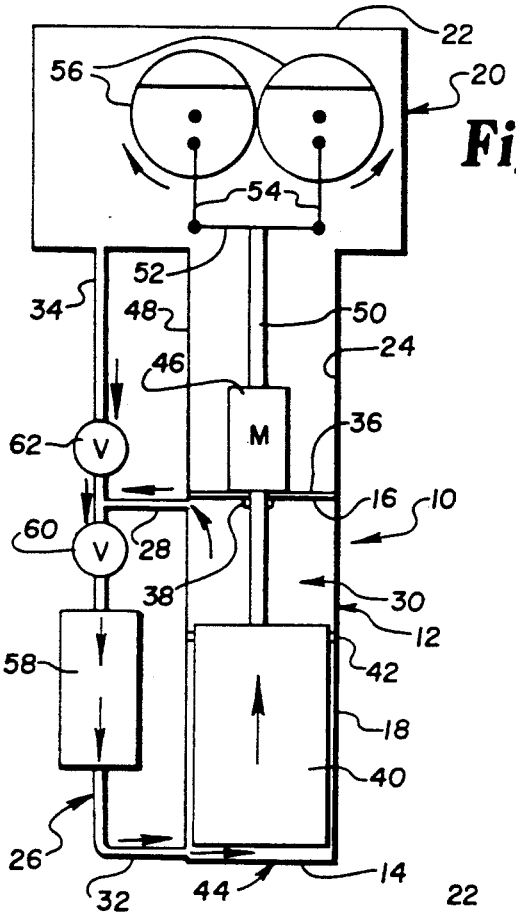
FIG. 1 is a mechanical schematic diagram of the present invention with a piston disposed in its first position.
Figure 2:
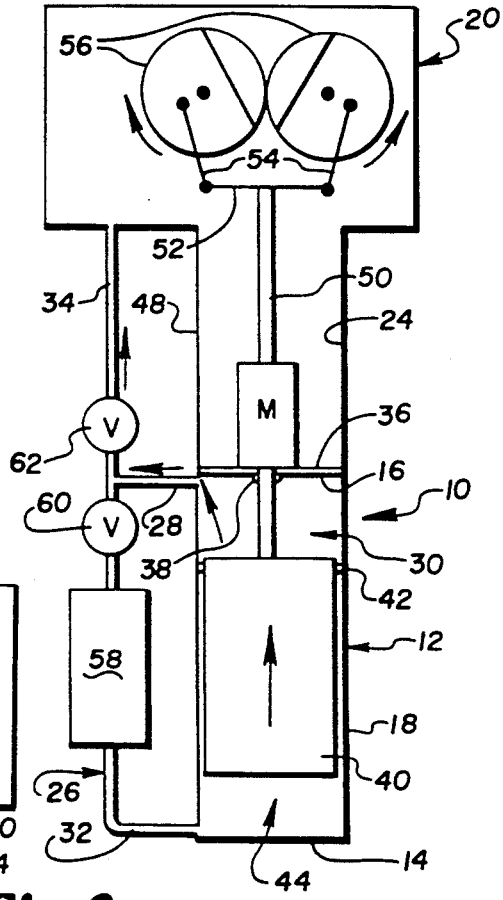
FIG. 2 is a mechanical schematic diagram, similar to FIG. 1, illustrating the piston in a position intermediate its first and second positions.
Figure 3:
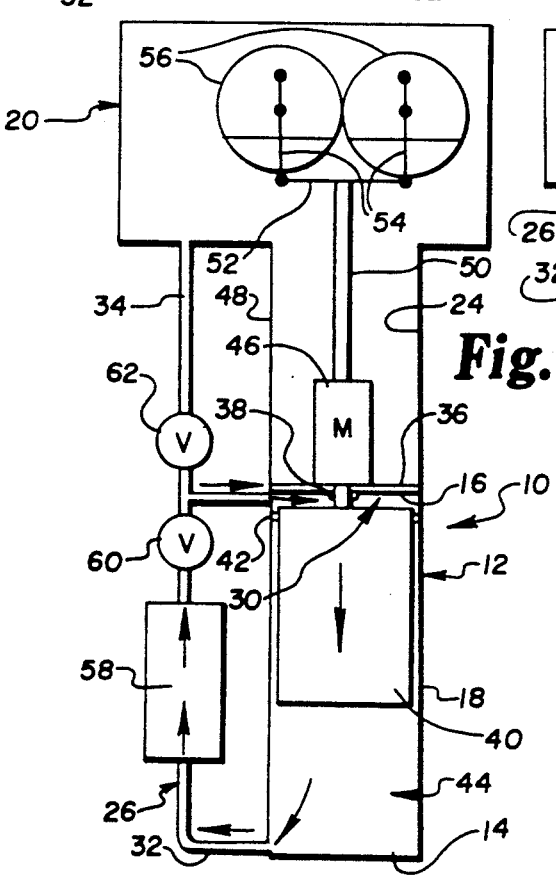
FIG. 3 is a mechanical schematic diagram, similar to FIG. 1, illustrating the piston in its second position.

Referring now to the drawing wherein like reference numerals denote like elements throughout the several views, FIGS. 1-3 illustrate the present invention and show the stages of a cycle of operation of the cooler 10. Referring first specifically to FIG. 1 with regard to the component parts, that figure illustrates a cylinder 12 having a first end 14, which, in the figure, is at the lower end, and a second end 16, which, in the figure, is at upper end. The cylinder 12 is defined by an enclosing wall 18. FIG. 1 also illustrates a fluid reservoir 20. The reservoir 20 is shown as having an upper portion 22 and a lower portion 24, generally aligned with the cylinder 12. It will be understood that this configuration is not exclusive. It is desirable, however, that at least a portion of the reservoir 20 be in alignment with the cylinder 12 for a reason as will be discussed hereinafter.

The figures also illustrate a conduit 26 which, at one end thereof, is in fluid communication with the reservoir 20 and is, at an opposite end thereof, in fluid communication with the first end 14 of the cylinder 12. A branch passage 28 interconnects the conduit 26 to the cylinder 12 proximate the second end 16 thereof to thereby, provide fluid communication between the conduit 26 and a second chamber 30 within the cylinder 12, as will be discussed hereinafter.

The branch passage 28 also functions to bifurcate the conduit 26 into two segments 32, 34. A first segment 32 is defined between the point of intersection of the branch passage 28 with the conduit 26 and the end of the conduit 26 which enters the first end 14 of the cylinder 12. A second segment 34 of the conduit 26 is defined between the intersection of the branch passage 28 with the conduit 26 and the end of the conduit 26 which enters the reservoir 20.

The interior of the cylinder 12 is segregated from the reservoir portion 24 which is in alignment with the cylinder 12 by a separating wall 36 and a seal 38. A piston 40 is received within the cylinder 12 and is disposed for reciprocation therewithin. It will be noted that a seal 42 is provided between the outer surface of the piston 40 and the inner surface of the wall 18 defining the cylinder 12.

As will be able to be seen, two chambers 44, 30 are defined within the cylinder 12. First chamber 44 is defined below the piston 40, and second chamber 30 is defined above the piston 40. The chambers 44,30 are variable in size as the piston 40 reciprocates, and their sizes vary inversely. That is, as the piston 40 moves upwardly, as viewed in FIG. 1, the volume of the first chamber 44 expands and the volume of the second chamber 30 contracts.

The figures also illustrate means for driving the piston 40 in its reciprocating movement. It is envisioned that the driving means would comprise a drive motor 46 disposed within the lower portion 24 of the reservoir 20 and, typically, coaxial within a cylindrical wall 48 defining that lower portion 24. The drive motor 46 shown in the figures serves to effect reciprocation of a piston shaft 50 extending from the lower portion 24 of the reservoir 20, through wall 36, into the cylinder 12 and mounting, at a distal end thereof, the piston 40.

The shaft 50 can be attached, at its opposite end, to a counter-balanced rotor assembly. The assembly includes a transverse member 52 mounted at this end of the shaft 50. The transverse member 52 includes segments extending similar distances on each side of the shaft 50. The terminus of each segment of the transverse member 52, in turn, mounts an arm 54 in a pivotal fashion. Each arm 54, it is intended, is of a length similar to the other arm 54.

Remote ends of the arms 54 are, in turn, eccentrically connected to counter-weighted rotors 56. The rotors 56 are counter-balanced in a fashion so that, as the shaft 50 reciprocates within the cylinder 12 and the lower portion 24 of the reservoir 20, the rotors 56 are made to rotate in opposite directions and give substantially equal counter-resistances. To this end, the rotors 56 would be mounted for rotation about axes which are symmetrically positioned relative to an axis along which the shaft 50 reciprocates. As a result of the provision of such structure, alignment of the shaft 50 can be maintained during operation of the cooler 10 and vibration of the over-all equipment can be minimized.

FIGS. 1-3 illustrate heat exchange regeneration means 58 interposed in the first segment 32 of the conduit 26. Such heat exchange regeneration means 58 can be of a construction as known in the prior art.

The figures also illustrate a pair of valves 60, 62 interposed in the conduit. The first valve 60 is shown as being interposed in the first conduit segment 32 between the heat exchange regeneration means 58 and the intersection of the branch passage 28 with the conduit 26. The second valve 62 is interposed in the second conduit segment 34.

Operation

Operation of the cryogenic cooler 10 in accordance with the present invention will now be discussed, first, with reference to FIG. 1. That figure illustrates the piston 40 in first position proximate a first end 14 of the cylinder 12. This position is typically, characterized as "bottom dead center" (BDC).

With the piston 40 in the BDC position, both the first and second valves 60, 62 are open. As the piston 40 is driven upwardly, however, fluid is drawn from the reservoir 20 into the first chamber 44 within the cylinder 12 through the conduit 26, since flow through the conduit 26 is unobstructed. As the piston 40 is driven from the BDC position upward, it attains a defined intermediate position as it moves to a second position proximate a second end 16 of the cylinder 12. As the piston 40 passes the defined intermediate position, closure of the first valve 60 is accomplished. Such operation can be effected in any appropriate manner. For example, a sensor could be provided within the cylinder 12 to ascertain that the piston 40 has attained the defined intermediate position. The sensor would, in turn, effect closure of the first valve 60 in a manner known in the prior art.

After the first valve 60 closes, polytropic expansion commences in the first chamber 44. Continued upward movement of the piston 40 drives fluid from the second chamber 30 through the branch conduit 28, and into the reservoir 20. Polytropic compression of the fluid in the reservoir 20 occurs.

When the piston 40 attains its second position, characterized as "top dead center" (TDC), the second valve 62 is closed in response to a sensing of the piston 40 being at this position. The first valve 60 is, concurrently, opened as the second valve is closed. As the piston 40 is driven downwardly within the cylinder 40, isochoric cold blow regeneration occurs within the heat exchange regeneration means 58. This process continues until the piston 40 attains its first position again proximate the bottom of the cylinder 12. Once the piston 40 attains its first position, the second valve 62 is again opened.

As in the case of closure of the first valve 60, concurrent closure of the second valve 62 and reopening of the first valve 60, and reopening of the second valve 62 can be effected in any appropriate manner. This can be done in a number of ways known in the prior art.

Figure 4:
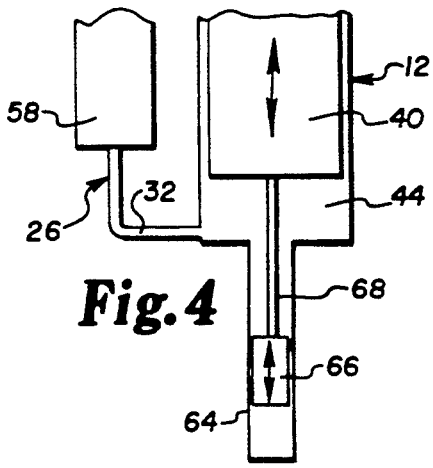
FIG. 4 is a fragmentary mechanical schematic diagram illustrating an alternative embodiment of the invention.

FIG. 4 illustrates an embodiment of the invention which can be employed in multiple staging operations. FIG. 4 illustrates the cylinder 12 as including a reduced diameter portion 64 extending coaxially from the first end 14 of the cylinder 12. A regenerative displacer 66, having a diameter similar to the inside diameter of the reduced diameter portion of the cylinder 64, is received within the reduced diameter portion of the cylinder 64. The regenerative displacer 66, it is intended, is slaved to the main piston 12 for reciprocation therewith. Reciprocation of the regenerative displacer 66 is totally within the reduced diameter portion 64 of the cylinder. Reciprocation of the regenerative displacer 66 is accomplished by an extension shaft 68 extending downwardly from the first end 14 of the main piston 12 into the reduced diameter portion 64 of the cylinder. This extension shaft 68 mounts, at its distal end, the displacer 66.

To effect multiple staging, regeneration is accomplished within the reduced diameter displacer 66. With this embodiment construction, it should be borne in mind that caution must be exercised to ensure that the volume change which occurs during second and subsequent stages is reactively small in comparison to the first stage expansion space. This is so in order to ensure that there is an adequate pressure fluctuation within the first chamber 44 during expansion which is sufficient to achieve efficient cooling. The use of this alternative construction is particularly suitable for lengthening the lifespan of the cooler equipment. This is so since valves and seals, in this embodiment, do not operate within the cold region of the cooler.

For further discussion, a number of assumptions must be made. The first is that all processes are reversible and perfect. Second, it will be assumed that an ideal gas is the working fluid. Third, it is assumed that the volume of the piston drive shaft is negligible. It is also hereinafter assumed that regeneration is perfect and that the reservoir is considered to be isothermal and infinite.

As previously discussed, when the first valve 60 closes as the piston 40 moves past a defined intermediate position, the gas in the first chamber 44 undergoes isothermal expansion. For purposes of discussion, the regenerator means 58 and its packing material may be considered an open thermodynamic system. This is so since mass flows isothermally into the first chamber 44 as expansion proceeds. The first chamber 44 is also considered to be another open system due to both the flow of mass and its exchange of heat with the outside. Such a transfer of mass decreases the rate of specific volume increase and, ultimately, decreases the specific volume expansion ratio within the first chamber 44.

Historically, there has been debate over how work is defined in an open thermodynamic system. More specifically, it has been debated whether work can be done at an arbitrary boundary as a result of mass flow. As applied to the present invention, this issue bears upon the question whether mass flows during expansion at the boundary between the regenerator 58 and the first chamber 44 results in work.

In the case of the present model, the decision was made to include the work due to mass contribution in the first chamber 44 and ignore mass diminution in the regenerator. This was done since the regenerator 58 is considered perfect and does not exchange heat directly with the ambient environment.

Although a decision made to exclude regenerator volume flow work within the regenerator 58 may seem merely a matter of appropriate selection of the thermodynamic system boundary, in the case of a more sophisticated model, wherein calculations are made based upon imperfect heat regeneration, the issue can be of greater significance. It is, therefore, necessary to consider the open/closed thermodynamic system work issue.

In view of the fact that the operation of a cooler 10 in accordance with the present invention involves working volume discontinuities as a result of valve operation for both cooling and heating, thermodynamic analysis is approached by solving for individual processes and then summating the total cooling and heating effects. The analysis employed hereinafter uses unit volume and dimensionless parameters, and the following nomenclature is employed:

| | | | |
|---|---|---|---|
| P | pressure | | |
| Q | heat | a | defined in equation 3 |
| R | gas constant | b | defined in equation 8 |
| T | temperature | r | $V_{cut}/V_m$ expansion expression |
| V | volume | P | reservoir pressure |
| W | work | | SUBSCRIPTS |
| f | $V_{reg}/V_m$ reg void vol | c | cold end, expansion |
| x | position of piston | cut | cutoff point |
| $\alpha$ | dimensionless bulk exp. | h | warm or ambient end |
| $\tau$ | temperature ratio | m | maximum |
| $P_o$ | Reservoir Pressure | | |

The final results are expressed in terms of specific work. In the case of an isothermal process, this represents net heat transfer. Consequently, numerical values obtained have no individual meaning. Rather, they must be used in a comparative manner in order to reach meaningful conclusions.

Cooling and heating effects for processes of expansion and regeneration in the isothermal heat exchange reaches of the cooler in accordance with the present invention my be expressed by the following integral:

$$Q_{net} = -\oint \alpha V dp;\ \alpha = 1 \quad (1)$$

The solution to this equation may be approached by equating the mass of the cut-off volume to the volume at the end of expansion within the first chamber 44. This is done in order to find the pressure as a function of cold cylinder displacement. The matter, therefore, resolves in the following equation:

$$\frac{P_o r V_m}{RT_c} + \frac{2P_o f V_m}{R(T_H + T_c)} = \frac{pxV_m}{RT_c} + \frac{2pfV_m}{R(T_H + T_c)} \quad (2)$$

Pressure is solved for:

$$P = \frac{P_o(r + a)}{x + a};\ a = \frac{2f}{1 + \tau} \quad (3)$$

and differentiation is performed:

$$dp = -P_o \frac{(r + a)}{(x + a)^2} \quad (4)$$

to arrive at an equation representative of the net heat transfer of expansion:

$$Q_{EXP,C} = P_o V_m (r + a) \int_r^1 \frac{x dx}{(x + a)^2};\ V_c = xV_m \quad (5)$$

Intergrating from the cut-volume to the end of expansion, the following equation results:

$$Q_{EXP,C} = P_o V_m (r + a) \left\{ \ln\left(\frac{1 + a}{r + a}\right) + \frac{a}{1 + a} - \frac{a}{r + a} \right\} \quad (6)$$

The result of this equation is a positive value in view of a judicious selection of the coordinate system in a manner to keep the convention that heat added to the system should be positive. Integration begins at r, since there is no specific volume increase from the integration from 0 to r, if the reservoir is considered infinite and in contact with the first chamber through the regenerator 58.

The effect of isochoric cold blow regeneration is deleterious to the overall cooling. This is so as a result of the increasing pressure in the first chamber 44 and its negative value. Applying the same strategy of equating masses, but changing the coordinate system to include the second chamber 30, the value for heating in the first chamber 44 is as follows:

$$\frac{p_x V_m}{RT_H} + \frac{p(1 - x)V_m}{RT_c} + \frac{2pfV_m}{R(T_N + T_c)} = \frac{P_m V_m}{RT_H} + \frac{2P_m f V_m}{R(T_H + T_c)} \quad (7)$$

Pressure is solved for:

$$P = P_m \left\{ \frac{1 + b}{(1 - \tau)x + b + \tau} \right\};\ b = \frac{2f}{1 + \tau^{-1}} \quad (8)$$

And differentiation results in:

$$dP = -P_m \left\{ \frac{(1 + b)(1 - \tau)}{[(1 - \tau)x + b + \tau]^2} \right\} \quad (9)$$

The heat transfer in the first chamber 44 during hot regeneration is found by solving the following equation:

$$Q_{req,c} = P_m V_m (1 + b)(1 - \tau) \int_0^1 \frac{(1 - x)dx}{[(1 - \tau)x + b + \tau]^2} \quad (10)$$

In solving, this reduces to:

$$Q_{req,c} = P_m V_m (1 + b) \left\{ \frac{1}{b - \tau} - \frac{1}{1 - \tau} \ln\left(\frac{1 + b}{b + \tau}\right) \right\} \quad (11)$$

$P_m$, the pressure in the second chamber 30, and void of the regenerator 58 after cold blow regeneration is completed must be found in terms of $P_o$ for normalizing reasons. This can be accomplished by equating the mass/temperature distribution of the gas at the cut-off volume to the volume after warm regeneration. This results in:

$$P_m = P_o \left(\frac{r\tau + b}{1 + b}\right) \quad (12)$$

This yields:

$$Q_{req,c} = P_o V_m (r\tau + b) \left\{ \frac{1}{b + \tau} - \frac{1}{1 - \tau} \ln\left(\frac{1 + b}{b + \tau}\right) \right\} \quad (13)$$

The amount of heating within the second chamber may be calculated for the warm regeneration process. The solution for the warm space employs the following equation:

$$Q_{req,H} = \frac{-P_o V_m (r\tau + b)}{1 + b} \left\{ 1 + \frac{1 + b}{1 - \tau} \ln\left(\frac{b + \tau}{b + 1}\right) \right\} \quad (14)$$

When the second valve opens during the operation of the cooler, the gas within the regenerator and second chamber is at a pressure in accordance with computation no. 12. This, however, complicates heat exchange within the reservoir. This is, however, an irreversible process, and the effects of the opening of the second valve will not be considered with respect to analysis of the ideal cycle.

With both the first and second chambers in fluid communication with the reservoir during hot blow regeneration, the process. is isochoric, and it requires no external work input period. When the first valve closes, the double acting piston continues upward with isothermal compression on the reservoir volume until the piston is at its TDC position. If the reservoir is nearly isobaric, work can be expressed in terms of the following equation:

$$W = 1 - r \quad (15)$$

In calculating the COP, the amount of external or work input used is in accordance with this equation.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. Apparatus for effecting cryogenic cooling, comprising:

(a) a cylinder defined by an enclosing wall;

(b) a piston disposed within said cylinder for reciprocation between a first position proximate a first end of said cylinder and a second position proximate a second end of said cylinder, and defining a first chamber within said cylinder at said first end thereof, and a second chamber within said cylinder at said second end thereof;

(c) means for driving said piston between said first and second positions;

(d) means sealing an outer surface of said piston against an inner surface of said cylinder enclosing wall to maintain said first and second chambers, in fluid isolation from one another;

(e) a single, closed fluid reservoir;

(f) a conduit interconnecting said reservoir and said first chamber to provide fluid communication therebetween;

(g) a branch passage diverging from said conduit to said second chamber at an intersection with said conduit to define a first segment of said conduit between said intersection and said first chamber, and a second segment of said conduit between said intersection and said reservoir;

(h) heat exchange regeneration means interposed in said first conduit segment;

(i) a first valve controlling fluid flow through said first segment of said conduit, said first valve interposed in said first segment of said conduit between said intersection and said regeneration means;

(j) a second valve controlling fluid flow through said second segment of said conduit, said second valve interposed in said second segment in said conduit intermediate said intersection and said reservoir; and (k) means for controlling operation of said first and second valves in response to the location of said piston as it reciprocates between said first and second positions thereof, wherein, when said piston is at said first position thereof, said first and second valves are both open, when said piston attains a defined intermediate position as it moves from its first position to said second position thereof, said first valve closes, when said piston attains its second position thereof, said first valve opens and said second valve closes, and, when said piston returns to said first position thereof, said first and second valves reopen.

2. Apparatus in accordance with claim 1 wherein said driving means comprises a shaft mounting said piston at one end thereof and a motor imparting reciprocation to said shaft.

3. Apparatus in accordance with claim 2 wherein at least a portion of said reservoir is axially aligned with said cylinder, said axially aligned portion of said reservoir segregated from said cylinder by a separating wall, and wherein said motor is mounted within said reservoir proximate said separating wall.

4. Apparatus in accordance with claim 3 further comprising means for maintaining alignment of said shaft for reciprocation along an intended axis.

5. Apparatus in accordance with claim 4 wherein said alignment maintaining means comprises a pair of counter-balanced rotors operatively connected to an end of said shaft within said reservoir.

6. Apparatus in accordance with claim 1 wherein said cylinder includes a reduced diameter portion extending coaxially from said first end of said cylinder, and further comprising a regenerative displacer, slaved to said piston, for reciprocation within said reduced diameter portion of said cylinder as said piston reciprocates within said cylinder.

7. Apparatus in accordance with claim 1 wherein said cylinder, said reservoir, said conduit, and said branch passage comprise a closed system.

* * * * *